US007231684B2

(12) United States Patent
Post

(10) Patent No.: US 7,231,684 B2
(45) Date of Patent: Jun. 19, 2007

(54) CLEANING APPARATUS

(75) Inventor: Kenneth P. Post, Lincoln Park, MI (US)

(73) Assignees: Consumer Solutions, Inc., Houston, TX (US); K & R Industries, Inc., Redford, MI (US)

( * ) Notice: Subject to any disclaimer, the term of this patent is extended or adjusted under 35 U.S.C. 154(b) by 296 days.

(21) Appl. No.: 10/948,512

(22) Filed: Sep. 23, 2004

(65) Prior Publication Data

US 2005/0034260 A1 Feb. 17, 2005

Related U.S. Application Data

(63) Continuation-in-part of application No. 10/366,774, filed on Feb. 14, 2003, now Pat. No. 6,795,999, which is a continuation of application No. 09/503,529, filed on Feb. 14, 2000, now Pat. No. 6,523,213, which is a continuation-in-part of application No. 09/104,957, filed on Jun. 25, 1998, now Pat. No. 6,178,584.

(51) Int. Cl.
*A47L 1/06* (2006.01)

(52) U.S. Cl. ..... 15/220.1; 15/144.1; 15/232; 16/900; 403/150

(58) Field of Classification Search ..... 15/144.1, 15/144.2, 172, 220.1, 228, 231, 232, 244.2; 16/438, 900; 403/119, 150–152, 154
See application file for complete search history.

(56) References Cited

U.S. PATENT DOCUMENTS

| | | | | |
|---|---|---|---|---|
| 296,235 | A | | 4/1884 | Sill |
| 672,584 | A | | 4/1901 | Anderson |
| 825,400 | A | | 7/1906 | Lightbown |
| 1,084,184 | A | | 1/1914 | Wenieke |
| 1,158,846 | A | | 2/1915 | Punch |
| 1,378,243 | A | * | 5/1921 | Kracke ..... 15/220.1 |
| 1,989,921 | A | | 2/1935 | Goddard |
| 1,993,571 | A | | 3/1935 | Soderberg |
| 2,127,886 | A | | 8/1938 | Plon |
| 2,192,910 | A | | 3/1940 | Hollenbeck |
| 2,291,435 | A | | 7/1942 | Anderson et al. |
| 2,301,586 | A | | 11/1942 | Rubin |
| 2,304,127 | A | | 12/1942 | Stetson |
| 2,315,325 | A | | 3/1943 | Gavurin |

(Continued)

FOREIGN PATENT DOCUMENTS

| | | |
|---|---|---|
| FR | 1056318 | 10/1953 |

(Continued)

*Primary Examiner*—Mark Spisich
(74) *Attorney, Agent, or Firm*—Young Basile Hanlon MacFarlane & Helmholdt P.C.

(57) ABSTRACT

A window cleaning apparatus includes a handle, a paddle and a cleaning element. The paddle is removably attachable to the handle. The handle includes oppositely extending end pins which are pivotally received in receivers carried on the paddle. At least one of the receivers has a bore which receives on of the handle end pins. At least one of the receivers is formed with separable members for forming a snap-connection with one of the handle end pins. The cleaning element has side edges with elastic to draw the ends of the side edges of the body inward to form an opening smaller than the outer diameter of the paddle to releasably attach the cleaning element about the paddle.

12 Claims, 4 Drawing Sheets

U.S. PATENT DOCUMENTS

| | | | | | |
|---|---|---|---|---|---|
| 2,560,008 | A | | 7/1951 | Steward | |
| 2,694,212 | A | | 11/1954 | McGraw | |
| 2,764,774 | A | | 10/1956 | Belsky et al. | |
| 3,362,037 | A | | 1/1968 | Griffin | |
| 3,704,479 | A | * | 12/1972 | Whitaker | 15/172 |
| 3,761,991 | A | | 10/1973 | Moss | |
| 4,503,579 | A | | 3/1985 | Nicely | |
| 4,822,194 | A | * | 4/1989 | Simonette | 401/207 |
| 4,926,522 | A | | 5/1990 | Wang | |
| 5,003,659 | A | | 4/1991 | Paepke | |
| 5,012,544 | A | | 5/1991 | Verry | |
| 5,095,574 | A | | 3/1992 | Khanzadian | |
| 5,333,347 | A | | 8/1994 | Stranders | |
| 5,556,470 | A | * | 9/1996 | Gruber | 118/264 |
| 5,596,787 | A | | 1/1997 | Steven et al. | |
| 5,603,138 | A | | 2/1997 | Bonis | |
| 5,657,507 | A | | 8/1997 | Wasak | |
| 5,876,141 | A | * | 3/1999 | Hsu | 401/207 |
| 5,918,342 | A | | 7/1999 | Smith et al. | |
| 6,178,584 | B1 | | 1/2001 | Post et al. | |
| 6,523,213 | B1 | | 2/2003 | Post et al. | |
| 6,769,153 | B1 | | 8/2004 | Post et al. | |
| 6,795,999 | B1 | | 9/2004 | Post et al. | |

FOREIGN PATENT DOCUMENTS

| | | |
|---|---|---|
| GB | 406211 | 2/1934 |

* cited by examiner

CLEANING APPARATUS

CROSS REFERENCE TO CO-PENDING APPLICATIONS

This application is a continuation-in-part of U.S. patent application Ser. No. 10/366,774 filed Feb. 14, 2003, now U.S. Pat. No. 6,795,999, issued Sep. 28, 2004, which is a continuation of U.S. patent application Ser. No. 09/503,529, filed Feb. 14, 2000, now U.S. Pat. No. 6,523,213, issued Feb. 25, 2003, which is continuation and a continuation-in-part of U.S. patent application Ser. No. 09/104,957, filed on Jun. 25, 1998, now U.S. Pat. No. 6,178,584, issued Jan. 30, 2001, the entire contents of each of which is incorporated herein by reference.

BACKGROUND OF THE INVENTION

1. Field of the Invention

The present invention relates, in general, to cleaning apparatus and more specifically, to apparatus for cleaning vehicle windows.

2. Description of the Art

Various tools are available to clean the exterior surface of vehicle windows. Such tools typically include a handle and a perpendicularly oriented cleaning element, such as a wiper blade, sponge rubber pad and combinations thereof. Water or ammonia based cleaning fluid is applied to the exterior surface of the vehicle window and scraped off by the tools to remove debris. Such tools are easy to use on the exterior surface of vehicle windows since the exterior surface of the vehicle windows is easily accessible both to apply cleaning fluid to the windows and to remove the fluid and debris from the windows.

However, such tools are ineffective in cleaning the inner surface of vehicle windows. The extreme angles of the vehicle windshield and backlight with respect to the dashboard and rear seat shelf in conjunction with adjacent vehicle components, such as the rear view mirror, steering wheel and rear, center brake light housing make it difficult to get the edges of a cleaning tool close to the extreme lower edges of the windshield and backlight. In addition, applying fluid, which is typically in the form of a spray, to the inner surfaces of the windshield and backlight results in a significant amount of the spray being deposited on the underlying horizontal surfaces adjacent to the windows, such as the vehicle dashboard and the rear shelf.

Thus, the most common implements used to clean the inner surfaces of vehicle windows are sponges, rags and paper towels. Manual force is exerted through the user's hands to manually apply cleaning fluid and/or spray to the inner surface of the windows and then to manipulate the cleaning element in a back and forth or circular motion across the surface of the windows. While a user may be able with a considerable amount of effort to clean most of the inner surface of the vehicle window, it is still difficult to completely clean the edges of the window and, more importantly, the lower edges of a vehicle windshield and backlight.

A variety of tools have been devised specifically to clean the inner surfaces of vehicle windows. Such tools are typically formed of a pad which is connected to an elongated handle. A cleaning element is attached to one side of the pad by various means including clips, straps, or hook and pile fasteners. However, each of these tools is specifically devised for a single type of cleaning operation, such as scrubbing or drying, but not both.

While such tools improve the reach of the user and enable the user to clean the lower edges of vehicle windows, and in particular, the windshield and backlight, it is believed that further improvements can be made to cleaning apparatus to make the cleaning apparatus easier to use in different applications, to provide easily detachable and interchangeable mounting of different shaped pads or plates to the handle, as well as providing easy replacement of wet, soiled cleaning elements.

SUMMARY OF THE INVENTION

The present invention is a cleaning apparatus particularly suited for cleaning and drying surfaces.

In one aspect, the cleaning apparatus includes a substantially rigid paddle having first and second opposed surfaces. The paddle may have a concave bend between opposed ends. A handle is pivotally connected on one end to the first surface of the paddle. A cleaning element is removably affixed to the paddle. The cleaning element includes a first surface mountable in registry with the second surface of the paddle and side edges disposed over a peripheral portion of the paddle. Elastic means are provided on the side edges of the cleaning element for elastically securing the cleaning element about the paddle.

Hinge means are cooperatively formed on the first surface of the paddle and the one end of the handle for pivotally connecting the paddle to the handle. Preferably, the hinge means includes first and second pivot pins extending coaxially outward from opposed sides of the one end of the handle. First and second receivers are mounted on the paddle for receiving the first and second pivot pins, respectively.

At least one receiver is in the form of a snap-like receiver formed of two resilient legs extending from the paddle. The legs are biased apart by insertion of one handle pivot pin therethrough and then close around the pivot pin to pivotally hold the pivot pin in the receiver. One of the receivers has a bore formed in a solid body and pivotally receives one of the pivot pins.

In another aspect, the above-described cleaning apparatus forms part of a cleaning system which includes a first handle, a plurality of cleaning elements of the same or different shape, and a plurality of paddles, at least some of which have a different peripheral shape. The cleaning elements are easily mountable onto any of the paddles to enable a clean and dry cleaning element to be used when needed. In addition, each of the paddles is quickly and easily attachable and detachable from the handle for ease in using the cleaning system of the present invention.

The cleaning apparatus of the present invention affords numerous advantages over prior cleaning apparatus devised for cleaning various surfaces. The present cleaning apparatus enables a plurality of different shaped paddles and attached scrubbing and drying elements to be detachably mounted on one handle for use in practically any cleaning application. The cleaning apparatus lends itself to use as part of a cleaning system formed of one or more handles, a plurality of different shaped paddles, and releasably attachable cleaning elements. The cleaning elements are easily mountable and removable from the paddles and the paddles are easily attachable and detachable to either handle.

BRIEF DESCRIPTION OF THE DRAWING

The various features, advantages and other uses of the present invention will become more apparent by referring to the following detailed description and drawing in which.

DETAILED DESCRIPTION

Figure 1:
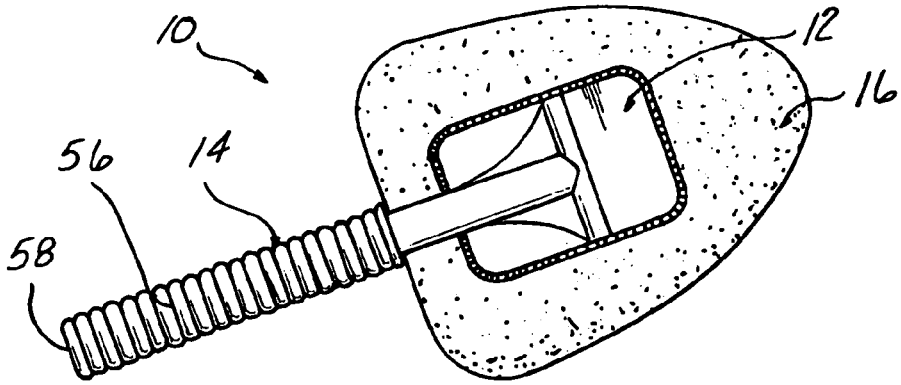
FIG. 1 is an assembled, perspective view of a first aspect of a cleaning apparatus with a drying element mounted thereon.

Referring now to the drawing, and to FIGS. 1–5 in particular, there is depicted a first embodiment of a cleaning apparatus 10 constructed in accordance with the teachings of the present invention. It will be understood that although the following description of the use of the cleaning apparatus 10 in cleaning and drying the interior surfaces of vehicle windows, the cleaning apparatus 10 may also be applied in a variety of other cleaning applications, such as to clean and dry the exterior surface of the vehicle windows, house or building windows, mirrors, or practically any surface that requires the use of a cleaning fluid and its removable from the surface being cleaned.

In general, the cleaning apparatus 10, includes a paddle 12, a handle 14, and a drying element 16.

Figure 2:
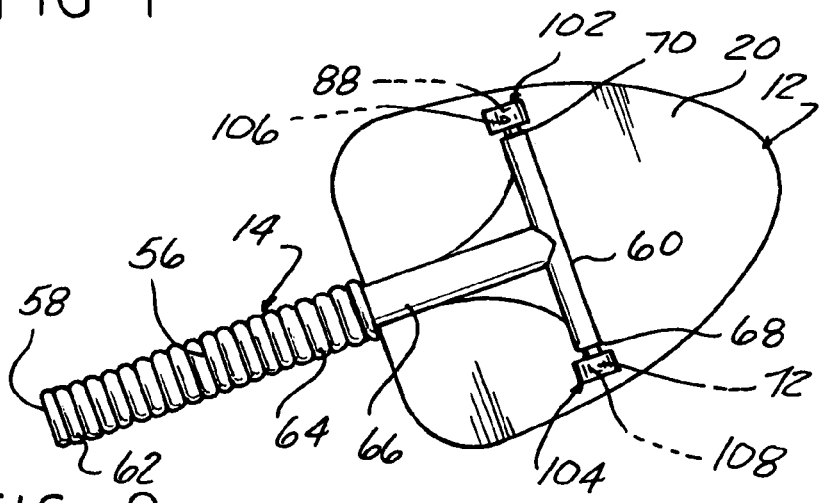
FIG. 2 is a perspective view of the handle and paddle of the cleaning apparatus shown in FIG. 1.
Figure 3:
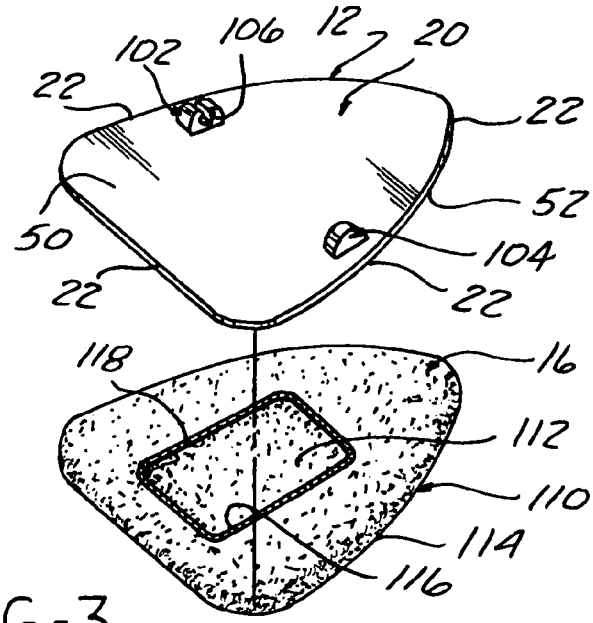
FIG. 3 is a perspective view of a first aspect of a drying element and paddle.

As shown in one aspect in FIGS. 1–3, the paddle 12 is formed of a generally planar plate 20 having one of a number of different configurations or sizes. The plate 20 is preferably formed of a lightweight material, with a suitable plastic material being preferred. However, other materials, such as metal, wood, composites, etc., may also be employed.

The plate 20, in one example, has a generally polygonal configuration with a plurality of exterior side edges each denoted by reference number 22. Rounded corners or radii are formed at the juncture of each of two side edges 22.

The plate 20 is also formed with a first or rear surface 50 and a second, opposed, front surface 52.

The plate 20 may be provided in two different sizes, such as a small size and a large size. By example only, a small size plate 20 may have dimensions of 5"×7". The larger plate 20 may have dimensions of 7"×9". It will be understood that the plate 20 may also be formed with a square configuration of equal length side edges 22 and with other square or rectangular dimensions as needed for a particular cleaning application.

The paddle 12 may also be formed in other configurations for drying different shaped windows or portions of a vehicle window. Thus, the plate may have a general oval shape with maximum dimensions of 7"×9" for a large oval shaped plate 5"×7" for a smaller oval shaped plate. All of the exterior surface or side edges of the paddle 12 are smoothly curved without any sharp projections or corners.

Figure 4:
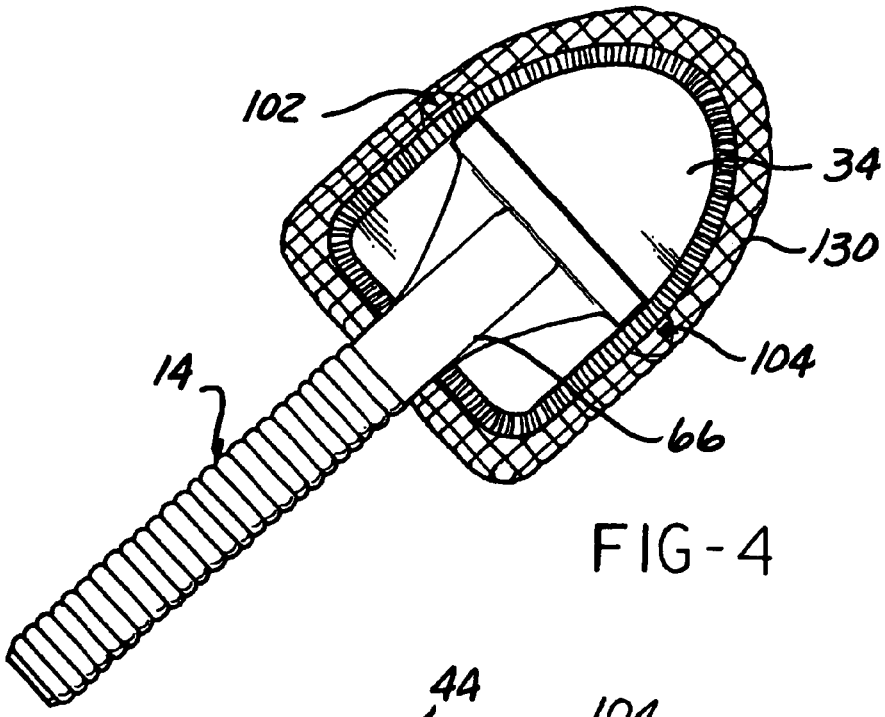
FIG. 4 is an exploded perspective view of a scrubbing element and paddle.
Figure 5:
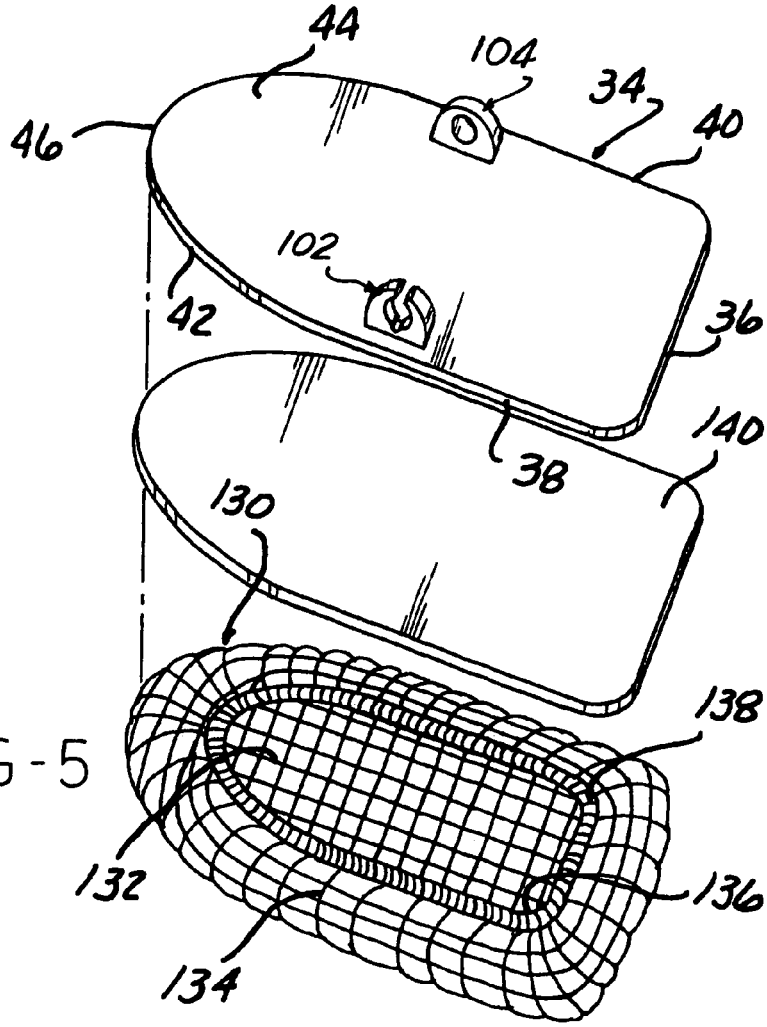
FIG. 5 is a perspective view of the assembled cleaning apparatus of FIG. 6A with the scrubbing element mounted thereto.
Figure 6:
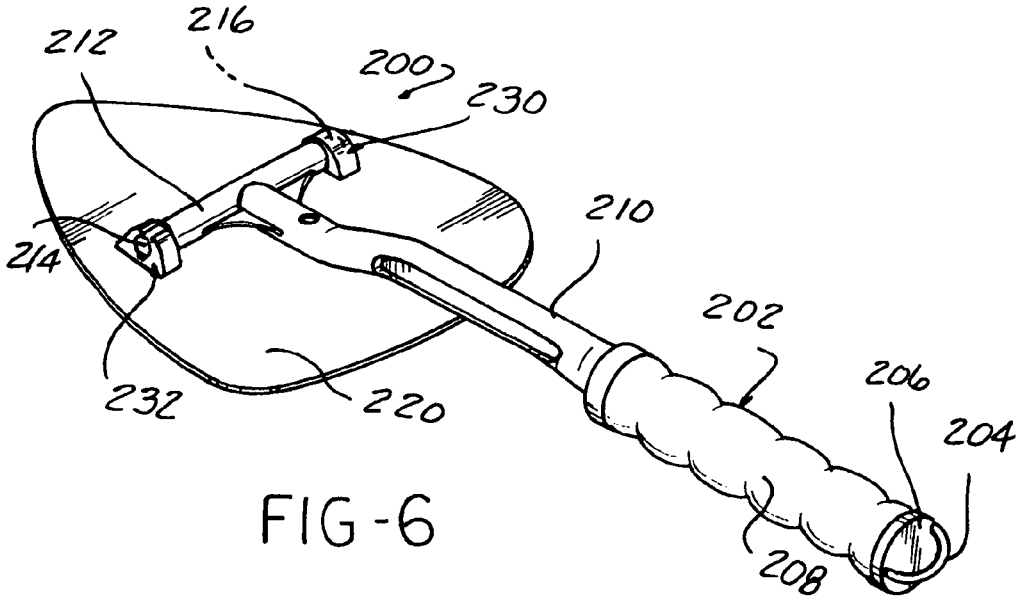
FIG. 6 is a perspective view of another aspect of a handle and paddle of a clean apparatus, with the cleaning element not being shown for clarity.

FIGS. 4 and 5 depict plate 34 which may also be used to form the paddle 12 of the cleaning apparatus 10. In this aspect, the plate 34 has a first flat side edge 36 which smoothly merges into two generally perpendicularly extending side edges 38 and 40. The side edges 38 and 40 have an end portion 42 and 44, respectively, which tapers inwardly toward each other thereby narrowing the width of the plate 34 at a second end 46 opposite from the side edge 36. The tapered portions 42 and 44 extend to a smoothly rounded apex or second end 46.

As shown in FIGS. 1 and 2, the paddle 12, regardless of its plate configuration 20, 30 or 34, may have a generally planar shape. A slight concave bend may also be formed in any of the plates 20 or 34 between opposed ends 36 and 46.

Referring now to FIGS. 1 and 2, the handle 14 of the cleaning apparatus 10 may take one of a variety of different shapes to provide a convenient gripping surface even when wet. Thus, by example, the handle 14, is formed of a lightweight material, such as a somewhat rigid, although flexible and slightly bendable plastic. The handle 14 is formed of an elongated member 56 of one of at least two distinct lengths and having a first end 58 and an opposed second end 60. The elongated member 56 extends generally planarly between the first and second ends 58 and 60. Although the member 56 may have a constant cross-section and a constant width dimension from end to end, in order to provide a more easily grippable surface 14, the member 56 is formed with a first enlargement 62 at the first end 58. The opposed side edges of the member 56 taper inwardly from the first enlargement 62 to a smaller width intermediate portion 64 before tapering outwardly to a second enlarged portion 66 adjacent the second end. At least a portion of the first enlargement 62 and the intermediate portion 64 of the member 56 may be formed with a rough or contoured exterior surface, such as a series of serrated, spaced ridges or projections as shown in FIGS. 1 and 2, to provide an easily grippable surface even when wet.

The cleaning apparatus 10 also includes means for mounting any of the plates 20 and 34, one at a time, to the handle 14. The mounting means includes means for detachably mounting the plates 20 and 34 to the handle 14. Means are provided for pivotally and detachably mounting the plates 20 and 34 to the handle 14.

According to one aspect shown more clearly in FIG. 2, the mounting means includes a pivot pin 72 mounted or unitarily formed on the first side edge 68 of the member 56. The opposite or second side edge 70 is has a pivot pin 88 mounted or unitarily formed thereon.

As shown in FIG. 2, the pins 72 and 88 are co-axially aligned and form part of hinge means which are rotatably mountable in opposed hinge member or receivers 102 and 104. Each of the hinge members or receivers 102 and 104 are preferably unitarily formed as part of the first or rear surface 50 of the paddle 12. Since the paddle 12 is preferably formed of a plastic, the hinge members 102 and 104 may be unitarily molded as part of the paddle 12.

Each of the receivers 102 and 104 are in the form of solid bodies which are unitarily formed as part of the plate 20 and project upwardly from the first rear surface 50 of the plate 20. As shown in FIGS. 2 and 3, each of the receivers 102 and 104 is formed with an inner face opposing the inner face of the opposed receiver and in a smoothly curved or arcuate shaped outer surface. Alternately, the receivers 102 and 104 may be simple flanges projecting perpendicularly from the first rear surface 50 of the plate 20. Each receiver 102 and 104 has an aperture 106 and 108 for receiving the pivot pins 72 and 88, respectively.

Thus, the internal bores or apertures 106 and 108, respectively, receive the pivot pins 88 and 72, respectively, on the handle 14 to pivotally couple any of the plates 20 and 34 to the handle 14 and enable substantially 180° pivotal movement of the handle 14 relative to the plates 20 and 34.

Referring now to FIGS. 6–9, another aspect of a cleaning apparatus 200 is depicted. In this aspect, the cleaning apparatus 200 includes a handle 202 having a mounting hangar 204 at a first end 206. A hand grip portion 208 extends from the first end 206 and is formed or covered with a high friction, easily grippable material.

The handle 202 continues from the hand grip portion 208 through a solid portion 210 to a T-shaped second end. Mounting pins 214 and 216, which may be integrally molded as part of the end 212 or fixedly mounted in the end 212, project oppositely from the end 212.

A paddle 220 has a generally triangular shape formed of a base 222, opposed angled or gently curved sides 224 and 226 and an apex 228 opposite the base 222. The center portion of the sides 224 and 226 may be raised slightly from a plane extending between the ends 222 and 228 along a longitudinal axis of the paddle 220 to form at least the bottom surface of the paddle 220 in a concave shape. The entire paddle 220 may have the same concave shape. Alternately, the central portion of the paddle 220 may have a greater thickness than the end portions 222 and 228.

Receivers 230 and 232 are integrally or separately fixed to one surface of the paddle 220. The receiver 230 is in the form of a body having an arcuate outer shape, for example. A bore 234 extends through at least one side of the first receiver 230 and opens toward the opposite receiver 232.

Figure 7:
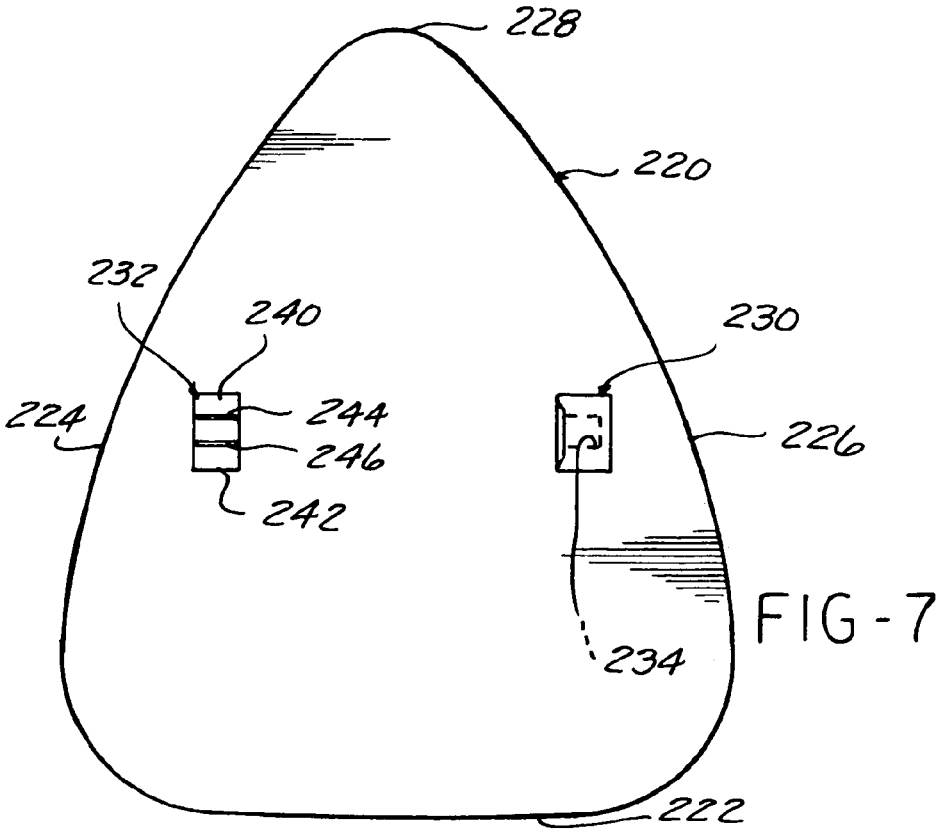
FIG. 7 is a plan view of the paddle shown in FIG. 6.
Figure 8:
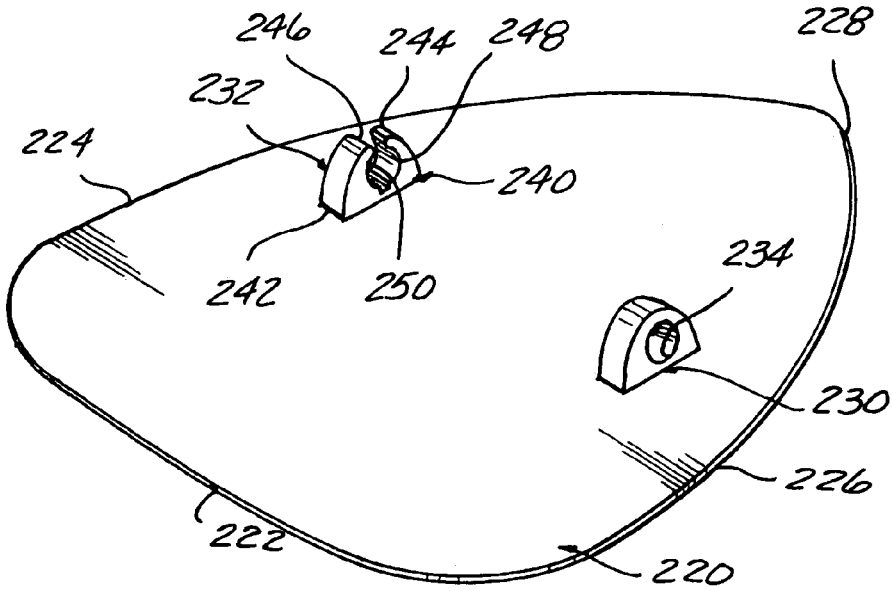
FIG. 8 is an enlarged perspective view of paddle shown in FIG. 7.
Figure 9:
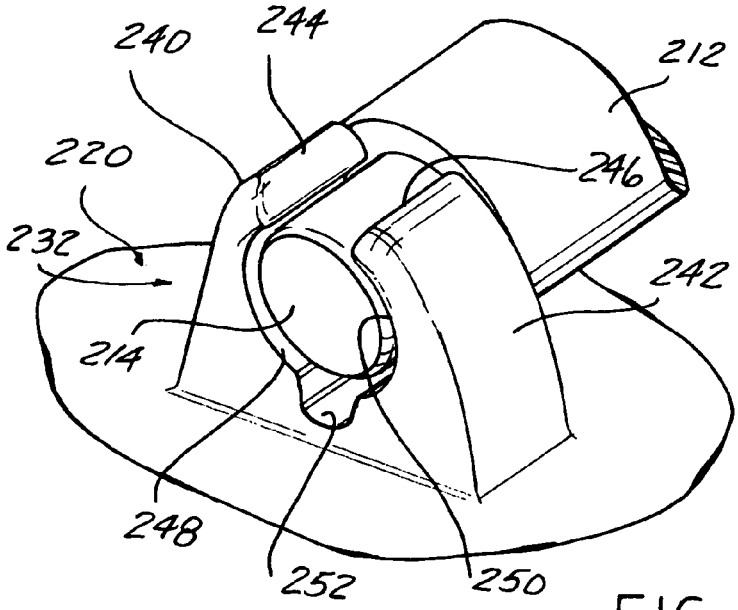
FIG. 9 is an enlarged, partial, perspective view of the handle to paddle connection shown in FIG. 6.

In this aspect, the receiver 232 forms a snap connection with the pin 214 on the handle 202. The receiver 232, shown in greater detail in FIGS. 7–9, is formed of first and second resiliently movable, spring legs 240 and 242. The legs 240 and 242 project from the top surface of the paddle 220 to an outer end 244 and 246, respectively. The inner surfaces of the legs 240 and 242 have a generally arcuate shape 248 and 250, sized to pivotally receive and capture the pin 214 on the handle 202, as clearly shown in FIG. 9. The inner space or distance between the ends 244 and 246 of the legs 240 and 242, respectively, is less than the outer diameter of the pin 214.

In use, the pin 214 is forced through the opening between the ends 244 and 246 of the legs 240 and 242 bending the legs 240 and 242 outward until the entire pin 214 passes through the ends 244 and 246. At this time, the legs 240 and 242 snap back to a normal position rotatably capturing the pin 214 therein.

If it is desirable to separate the handle 202 from the paddle 220, a reverse operation is employed in which the pin 214 is forcibly pulled through the opening between the ends 244 and 246 of the legs 240 and 242.

As shown in FIGS. 8 and 9, an aperture 252 may be formed at a bottom portion of the legs 240 and 242 to facilitate resilient movement or bending of the legs 240 and 242 as described above.

It will be understood that the snap-connection provided by the receiver 232 can also be repeated for the receiver 230 by forming the receiver 230 in the same manner as the receiver 232.

A first drying element aspect of the cleaning element which is removably mountable on the paddle 12 is shown in FIG. 3. In this embodiment, the drying element is in the form of a pliable body 110 sized to releasably mount about the plate 20 of the first embodiment of the paddle 12. Thus, the body 110 has a first major surface 112 which is disposable adjacent a second front surface 52 of the plate 20, a continuous side edge 114 extending from the first major surface 112, and a peripheral edge 116 surrounding an open end opposite the first surface 112. The peripheral edge 116 may be stitched to prevent unraveling or separation of the fibers forming in the body 110. Preferably, the body 110 is formed of an absorbent material, such as cotton, etc.

Elastic means 118 in the form of an elastic band is stitched or otherwise attached to the peripheral edge 116 of the body 110 to provide an elastic force for closing the peripheral edge 116 to a small open diameter to thereby securely, yet releasably mount the body 110 about the paddle 12. At the same time, the elastic means 118 allows the body 11 to be easily removed from the paddle 12 and replaced with a clean, dry body 110 when necessary.

It will be understood that the body 110 may be provided in different sizes to conform to the shape and size of the large or small plates 20 described above.

Yet another body 130, shown in FIGS. 4 and 5, may be used as the cleaning element 16 for the plate 34. Like the other bodies 110, the body 130 is formed of a first, generally planar surface 132, a side edge 134 which terminates in continuous peripheral edge 136 surrounding an opening, and elastic means 138 secured to the peripheral edge 136. The peripheral edge 136 and the side edge 134 are preferably formed in the shape of the plate 34 to enable the body 130 to be removably mounted about and to conform to the shape of the plate 34. As shown in FIG. 5, an absorbent layer or pad 140 of substantially the same shape as the plate 34 is interposed between a major surface of the plate 34 and the first major surface 132 of the body 130 to provide fluid absorbent features. The pad 140 can be loosely interposed between the plate 34 and the body 130 or fixed on the plate 34 by adhesive or other suitable means. The body 130, in this embodiment, is preferably formed of a mesh or rough material to act as a scrubbing surface in conjunction with a fluid filled absorbent layer 140 which dispenses fluid during the scrubbing operation. Thus, the body 130 and absorbent layer 140 function as a scrubbing element to apply cleaning fluid to a window and, with suitable scrubbing movement, to simultaneously loosen dirt and other debris from the window.

The various drying and cleaning bodies 110 and 130 shown in FIGS. 3–5 may be used to perform a variety of cleaning or drying tasks. Any of the bodies 110 may be used merely as a dusting cloth to remove dust from a vehicle window or other interior vehicle surface. Further, the body 130 shown in FIG. 4 and its associated plate 34 with the rounded end 46 and interior absorbent layer 140 is ideally suited to act as a sponge and scrubbing surface in applying cleaning fluid or water to the interior surface of a vehicle window and scrubbing or removing debris stuck on a window.

Once the absorbent layer 140 is wetted with the cleaning fluid, the handle 14 of the cleaning apparatus 10 is grasped by one hand of the user and then moved adjacent to the window until the body 130, contacts the interior surface of the window. The cleaning element 10 is then moved in any motion, such as back and forth, sideways, circular or combinations thereof to apply the cleaning fluid to the entire interior surface of the window and to remove any debris stuck on the window. The body 130 and plate 34 are then removed from the handle 14 by simply reversing the insertion operation as described above to detach the plate 34 from the handle 14. One of the other bodies 110 and its associated plate 20, respectively, can then attach to the handle 14 as described above. The body 110 is then brought into engagement with the window and again moved in any fashion across the entire surface of the window to dry the previously applied cleaning fluid and remove any loose debris from the window.

If, at any time, the body 110 becomes saturated with cleaning fluid or accumulates a significant amount of dirt or other debris, the user may simply remove the body 110 from the associated paddle 12 and then mount a clean, dry body 110 on the paddle 12 to continue with the cleaning operation.

Thus, there has been disclosed a unique cleaning apparatus and cleaning system for cleaning and drying the interior surfaces of windows and, particularly, vehicle windows which is easy to use, is capable of scrubbing and drying all of the window surfaces, including the lower edges adjacent the vehicle dash board and rear shelf, has easily detachably mounted paddles and scrubbing and drying elements enabling different shaped paddles and fresh, dry cleaning elements to be easily attached to the handle for scrubbing and drying various portions of or different shaped windows as well as enabling the cleaning elements to be easily removed when wet or soiled and a new element applied to the paddle.

What is claimed is:

1. A cleaning apparatus comprising:

a paddle, the paddle having a peripheral edge;

a cleaning element removably affixed to the paddle, the cleaning element including a body and means for elastically and removably securing the body to the paddle;

a handle having opposed outwardly extending end pins; and first and second receivers spacedly carried on the paddle, each of the first and second receivers pivotally receiving one pin on the handle to pivotally connect the handle and the paddle for pivotal movement with respect to each other only about an axis extending between the first and second receivers, one of the first and second receivers formed with separable members defining an access opening for receiving one of the end pins of the handle in a snap-connection and the other of the first and second receivers having a bore extending through at least one side and bounded by a wall of the receiver for receiving the other one of the end pins.

2. The cleaning apparatus of claim 1 wherein:

the paddle has opposing first and second ends, wherein the paddle forms a concave shape between the first and second ends.

3. The cleaning apparatus of claim 1 wherein:

the handle and the end pins are formed as a one piece, unitary member, wherein the handle is integrally formed to a tubular member having the end pins on opposing sides of the tubular member and wherein the end pins have a smaller diameter than the tubular member.

4. The cleaning apparatus of claim 1 wherein the body of the cleaning element comprises:

a first surface aligned with the paddle, and side edges disposed over a peripheral edge of the paddle.

5. The cleaning apparatus of claim 4 wherein:

the side edges of the cleaning element are drawn inward by the securing means to form an opening normally smaller than the dimensions of the peripheral edge of the paddle when the cleaning element is affixed to the paddle.

6. The cleaning apparatus of claim 1 wherein the cleaning element is formed of a fluid absorbent material.

7. The cleaning apparatus of claim 1 wherein the cleaning element is formed of a rough textured material to form a scrubbing surface.

8. The cleaning apparatus of claim 7 wherein the rough textured material is an open mesh material.

9. The cleaning apparatus of claim 7 further comprising:

a fluid absorbent material layer interposed between the paddle and the cleaning element for dispensing fluid through the cleaning element.

10. The cleaning apparatus of claim 1 further comprising:

the first and second receivers separately carried on the paddle.

11. The cleaning apparatus of claim 1 wherein:

the first and second receivers are integrally molded with the paddle.

12. The cleaning apparatus of claim 1 wherein the one of the first and second receivers formed with separable members comprises:

first and second bendable legs extending from the paddle and terminating in spaced outer ends;

inner opposed facing surfaces of the first and second legs shaped for pivotally receiving one of the end pins on the handle; and the outer ends of the first and second legs spaced apart at a distance less than the outer diameter of the one end pin on the handle.

* * * * *